US007234244B2

(12) United States Patent
Lindberg

(10) Patent No.: US 7,234,244 B2
(45) Date of Patent: Jun. 26, 2007

(54) METHOD AND APPARATUS FOR MEASURING THE POSITION OF AN END HEAD OF A ROLL

(75) Inventor: Harri Lindberg, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 5 days.

(21) Appl. No.: 10/564,167

(22) PCT Filed: Jul. 1, 2004

(86) PCT No.: PCT/FI2004/000418

§ 371 (c)(1),
(2), (4) Date: Jan. 10, 2006

(87) PCT Pub. No.: WO2005/005258

PCT Pub. Date: Jan. 20, 2005

(65) Prior Publication Data

US 2006/0179673 A1 Aug. 17, 2006

(30) Foreign Application Priority Data

Jul. 11, 2003 (FI) ..... 20031066

(51) Int. Cl.
*G01D 21/00* (2006.01)

(52) U.S. Cl. ..... 33/520; 33/644

(58) Field of Classification Search ..... 33/520, 33/1 CC, 644
See application file for complete search history.

(56) References Cited

U.S. PATENT DOCUMENTS 3,718,977 A * 3/1973 Kraklau et al. ..... 33/644
3,823,482 A * 7/1974 Schiler ..... 33/520
4,339,904 A 7/1982 Koutonen et al.
4,926,337 A * 5/1990 Gile ..... 33/644
5,157,265 A 10/1992 Uomala
5,376,805 A 12/1994 Nieminen et al.
5,926,781 A * 7/1999 Scott ..... 33/503

FOREIGN PATENT DOCUMENTS

EP 0610662 A1 8/1994
EP 0610758 A2 8/1994

* cited by examiner

*Primary Examiner*—Christopher W. Fulton
(74) *Attorney, Agent, or Firm*—Cohen Pontani Lieberman & Pavane LLP

(57) ABSTRACT

A method and apparatus for determining the position, relative to the grab (1, 2) transporting them, of the end heads used in packing paper, cellulose, and board rolls, when the end head is attached to the grab (1, 2). When measuring, a detector (7) is transported along such a circular curve, which is assumed to be intersected by the circular curve defined by the edge of the end head. the angle position of the detector (7) on the circular curve of its path is measured and the intersection points (x1, z1; x2, z2) of the curve travelled by the detector (7) and the edge of the head are detected. The position of the centre point (x0, z0) of the end head is calculated on the basis of (a) the radius of the circle travelled by the detector and the position of the centre point (xm, zm) of the circle, (b) the position (xt, zt) of the grab's tool point, (c) the assumed radius of the end head, and (d) the positions (x1, z1; x2, z2), of the detected intersection points. Finally, the position of the centre point (x0, z0) of the end head is calculated in the set of coordinates of the grab.

13 Claims, 5 Drawing Sheets

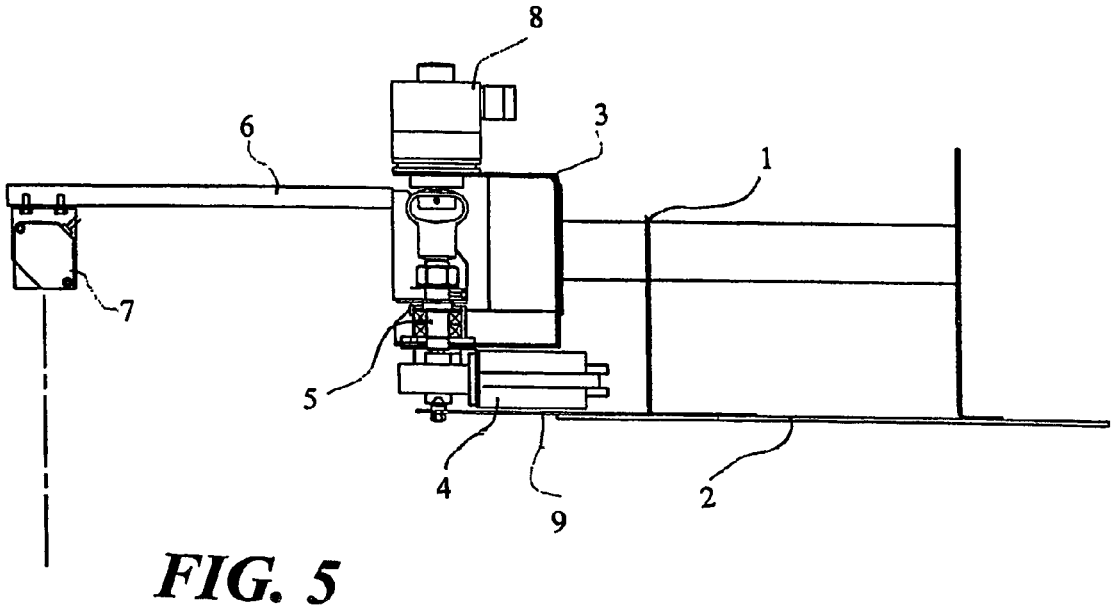
FIG. 5
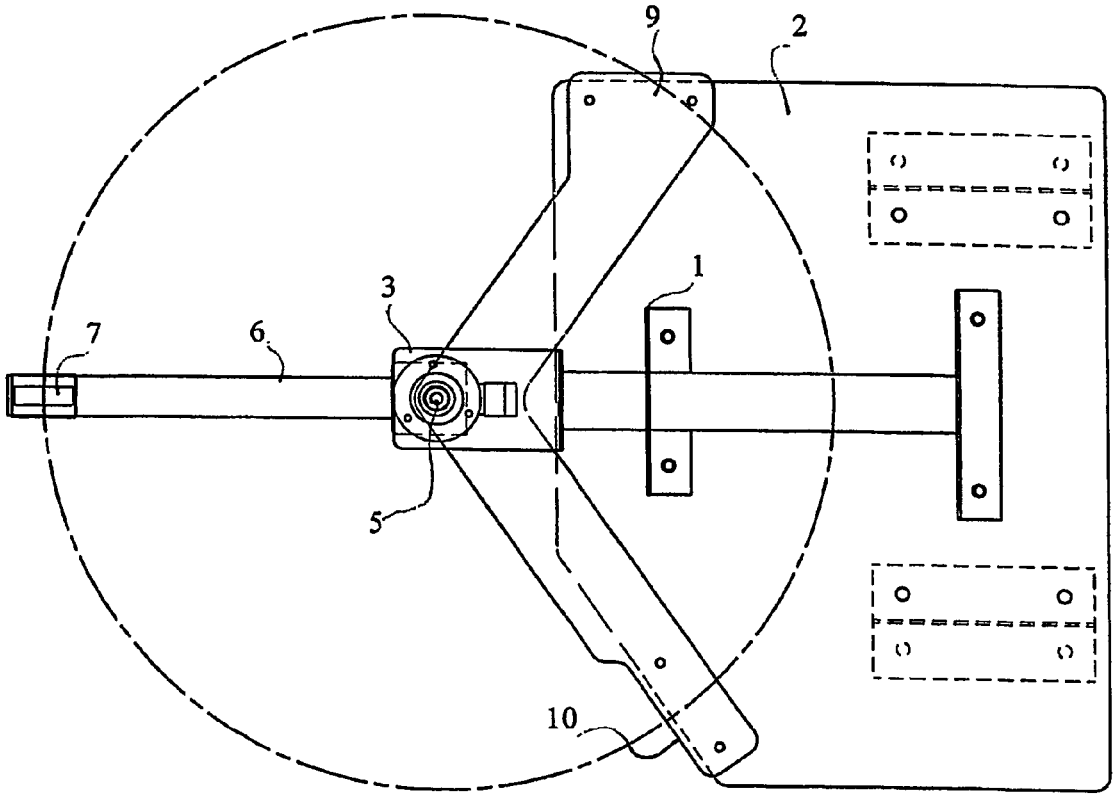

METHOD AND APPARATUS FOR MEASURING THE POSITION OF AN END HEAD OF A ROLL

PRIORITY CLAIM

This is a national stage of PCT application No. PCT/FI2004/000418, filed on Jul. 1, 2004. Priority is claimed on Application No. 20031066, filed in Finland on Jul. 11, 2003.

BACKGROUND OF THE INVENTION

The present invention relates to a method for determining the location, relative to the grab transporting it, of the end heads of rolls used for packing rolls of paper, cellulose, and board.

The invention also relates to an apparatus intended to apply the method.

The wide roll of paper coming from a paper machine is first of all transported to a slitter-winder and cut into rolls of suitable width. Next, the rolls are packed for transport. When paper rolls are packed, inner end heads are first of all placed on their ends, after which the necessary amount of wrapping is wrapped around the roll, the ends of which are folded on top of the inner end heads at the ends of the roll. An outer end head is glued on top of the folded wrapping and the internal end head, usually by hot-sealing. The inner end head is normally quite thick and protects the end of the roll from mechanical damage. The outer end head is, in turn, thinner and its task is to secure the package on the end of the roll and protect the roll from moisture. Often the color and patterning of the outer end head are used to give the roll a neat appearance. The length and diameter of the roll being packed are measured prior to packing and suitably sized end heads are selected for the ends of the roll of the basis of the measurement results.

End heads can be placed on the ends of rolls in many different ways. Placing the heads by hand is the oldest method, which is still very suitable for packing lines with a reasonably small capacity, or in applications in which there is no need to increase the level of automation. In this case, the packer simply places the inner heads by hand on the ends of the roll and correspondingly the outer heads onto heat-press plates, which press the outer heads onto the ends of the roll. The inner heads can also be moved manually with the aid of an air blast, or mechanically without touching them. The inner end heads are held on the end of the roll using a separate arm while the ends of the edges of the wrapping are being folded. The outer heads are, in turn, attached to the press plates by vacuum suction. In manual placing, the packer ensures that the heads of the right size are used on the roll and that they are correctly placed.

Various kinds of automatic end-head setting devices have been used already for a long time and many different kinds of them exist. A common feature of nearly all automatic head-setters is that there is a device including a grip for both ends of the roll, which transfers the head from a pile of heads onto the end of the roll. In one known end-head setter, there is a rotating arm located in a vertical guide, at the end of which is a rotating vacuum grip for gripping the heads. Such a head setter is usually used with separate head shelves located next to the setter. Heads are set on the end of the roll using this device, in such a way that the arm is moved along the vertical arm to the height of the shelf on which there are the correctly sized heads. The grab arm and the grab are rotated until the grab is parallel with the shelf top, after which the head is picked off the shelf and transferred to the end of the roll by rotating the arm and grab and moving them along the guide. In this type of device, there is usually no separate device for measuring the size and position of the end heads.

In another system, the end heads are placed in piles on the floor of the mill hall and are transferred to the end of the rolls using a portal-operation head setter. The transfer portal is built above the piles of heads and the head setters are generally installed on the same transversely movable guides. Thus, there must be a separate pile of heads of a specific size for each grab. U.S. Pat. No. 5,157,265 discloses a method for determining the size and position of end heads, which is suitable for use in connection with the above system. In this measurement method, the end head lifted by the grab is taken at a known speed past two pairs of photoelectric cells, so that the arrival of the front edge of the head at the position of the cells and the passing of the rear edge of the head are detected on the basis of the change in the signals of the photoelectric cells. The distance between the points of intersection can be calculated form the known speed of the head and the difference in the time of change in the signals. Because the shape of the head is known, its position and size can be determined. Because the lifting position of the grab relative to the head pile is known, the real position of the head pile can be determined from the position of the head on the grab.

Instead of the end-head handling methods described above, it is possible to use a standard model industrial robot with several degrees of freedom in head handling. Such a robot can be located in connection with a packing line, in such a way that it can be used to place an end head on each end of a roll. In order to make the robot operate efficiently, it must use a two-sided grab, by means of which it can pick up heads for both sides one after the other, by rotating the grab in between, thus eliminating the need for two lifting movements. Two robots can also be used, in which case a shorter stage time will be achieved.

The method disclosed in U.S. Pat. No. 5,157,265 has, however, several weaknesses, due to which it is not suitable for use in the transfer of end heads taking place with a robot. Because a two-side grab, in which the heads are on top of each other, must be used with the robot, the photoelectric cells are not able to distinguish from which edge of the head the signal changes, so that this method cannot be used when using a two-sided grab, unless depth-range detection is set for the photoelectric cells, so that they will detect only the desired head from heads lying on top of each other. Because only two photoelectric cells are used in the method, it cannot be used to detect edge damage. If a faulty part of the edge coincides with the path of the photoelectric cell, the size and position of the head will be calculated wrongly and the head may be taken to broke, even though in fact it might be completely usable. The rejection of a head is not in itself a problem, but after rejection a new head must be lifted, which of course will disturb the operation of the packing line. Usually, however, the head is taken to the press plate and the operator is given an error notification, when he will correct the position of the head visually or place a new head on the press plate. This can only be done when the movements of the robot are sufficiently slow while correction of error situations greatly disturbs the operation of the packing line. The movements of the robot must be slowed for reading of the position of the end head to be made with sufficient precision. Similarly, in an error situation, the movement must be stopped, so that the operator can safely enter the area of movement of the robot. Thus, it is possible to operate in the manner described above also when using robot head setting, but the greatest benefit will not, however, be gained from the robot, due to the necessarily slow speed of movement of the robot.

In addition, in this system the position of the head is compared with the position of the reference point of the grab, the location of which is known the whole time on the basis of the signal given by the movement sensors of the transfer apparatus. Thus, the method cannot be applied when using industrial robots, because with rapid movements the position data of the robot cannot be determined continuously. In the case of robot head setting, the reference point of the grab must be determined in some other way than from the position data of the robot, because the movement of the robot cannot be slowed/is not worth slowing during the measurement to such an extent that the position data can be read.

U.S. Pat. No. 5,376,805 discloses a method for determining the size and position of an end head relative to the grab transporting the head. The grab is moved by a robot with several degrees of freedom and the measurement of the head takes place in a separate measuring station. The measuring station has three photoelectric cells, passed which the head is taken. A detection element is fitted to the grab, with the aid of which the position of the tool-point of the grab is determined when the grab passes the first detection element. The position and size of the head is determined on the basis of the segments obtained with the aid of the signals given by the detectors from the edges of the head. In this solution too, a separate measuring station is used, so that the transfer of the head to the end of the roll is slow, or else a high-efficiency robot must be used, by means of which a high acceleration and deceleration can be achieved. If the size of the head is not determined, but is instead given as initial data to the system, only two photoelectric cells will be needed and two points for determining the position of the end head.

SUMMARY OF THE INVENTION

The present invention is intended to create a method, with the aid of which the position and location of the end head can be determined directly from the grab, without requiring a separate measuring station.

The invention is based on an arm, the angle of which around its axis of rotation can be determined, and which is rotated around a shaft at one end, being fitted to the grab handling the end head. The arm is rotated around the shaft, in which case it passes the edge of the head and the moment of passage is detected by a photoelectric cell which is at the end of the arm. The size and position of the end head can be calculated on the basis of the angle of the arm, because the length of the arm and the position of its axis of rotation relative to the tool point of the grab are known.

Considerable advantages are gained with the aid of the invention.

The most important advantage of the invention is that the position of the end head can be determined during the transfer movement of the head, while the head is attached to the grab. Thus, extremely rapid measurement is achieved. The use of the methods referred to above do not achieve a sufficiently rapid stage time on modern high-capacity packing lines and the invention solves precisely this problem. The end head need not be taken to a separate measuring station, so that one work stage is eliminated from the transfer of the head. Thus the transfer movement of the head can be substantially accelerated and the capacity of the packing system can be in this way increased, or else cheaper and slower robots or manipulators can be used for the transfer of the end heads. Because a separate measuring station is not needed, the floor space demanded by the packing system is reduced and the path of motion of the grab can be designed more freely. This brings benefits particularly when rebuilding packing system and in existing mill premises. Naturally, the price of the system is also lower, as one separate device can be eliminated.

BRIEF DESCRIPTION OF THE DRAWINGS

In the following, the invention is examined with the aid of the accompanying drawings.

FIG. 5 shows one device according to the invention.

DETAILED DESCRIPTION OF THE PRESENTLY PREFERRED EMBODIMENTS

The lifting of the end heads and the placing of them on the ends of the rolls can be implemented with the aid of the invention in such a way that, with the aid of the grab, an end head is lifted from the pile, the position of the end head on the grab is measured, and the head is transported to the end of the roll. The measurement can take place when the grab is stationary, or when the grab is moving. In the actual measurement event, a measuring arm of known length is rotated in such a way that its free end passes over the edge of the head, so that two measurement points are detected, one when the end of the arm moves outside the area of the head and the other when the end of the arm returns again over the head.

The size and centre point of the head are calculated as follows. When the end head is picked onto the grab, it is usually located slightly eccentrically relative to the tool point of the grab. The eccentricity is due to the inaccuracy of the position of the grab or the head pile, or to the construction of the grab, in which case the centre point of the head is always at a distance from the tool point, when it is lifted. Once the position of the axis of rotation of the measuring arm relative to the tool point is known, as are the length of the arm and the angle of the arm, the centre point of the head can be calculated. For calculation, the points of intersection of the end of the measuring arm and the edge of the head are determined within the set of co-ordinates of the suction head.

Figure 1:
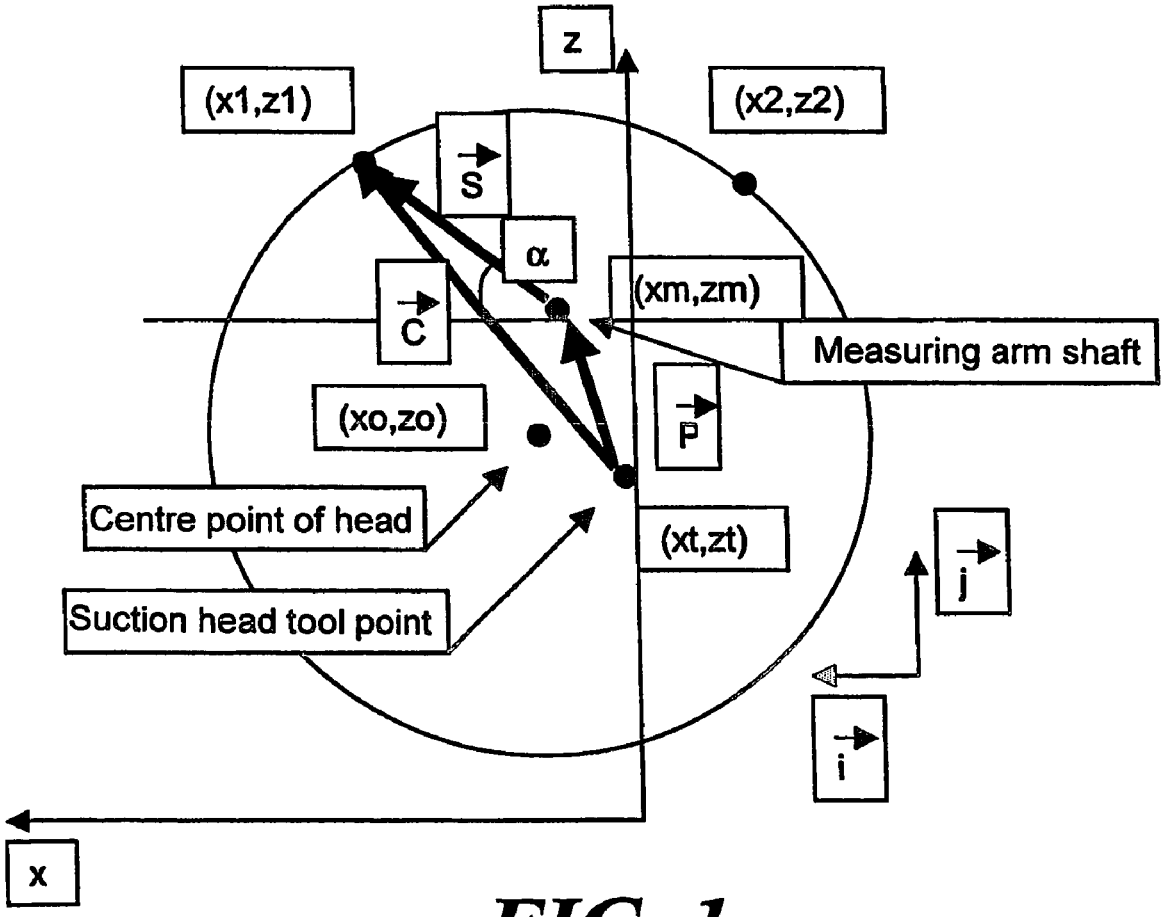
FIG. 1 shows a schematic diagram of the first calculation stage in the measuring method according to the invention.

The determining of the points (x1,z1) and (x2,z2) within the set of co-ordinates of the suction head takes place according to FIG. 1. The angle $\alpha$ is obtained with the aid of an absolute sensor, which is connected to the shaft of the measuring arm. The absolute sensor is read at the moment when the sensor at the end of the measuring arm, e.g., a photoelectric cell, reacts. $\alpha$ is thus a measurement result and the position of the measuring arm is always the same as the length of the measuring arm. With the aid of the angle $\alpha$, the vector S from the axis of the measuring arm to the point (x1,z1) at the edge of the head can now be determined. FIG. 1 shows that Vector C=P+S, so that by adding the now known vectors together the position of the point (x1,z1)

within the set of co-ordinates of the suction head, i.e. relative to the tool point of the suction head, is obtained.

The co-ordinates of the point (x2,z2) are obtained in a corresponding manner. Once two points on the circumference of the circle have been determined and the assumed radius of the head is known, the position of the centre point of the head is determined once it is also known on which side the straight line running through the points is located.

Figure 2:
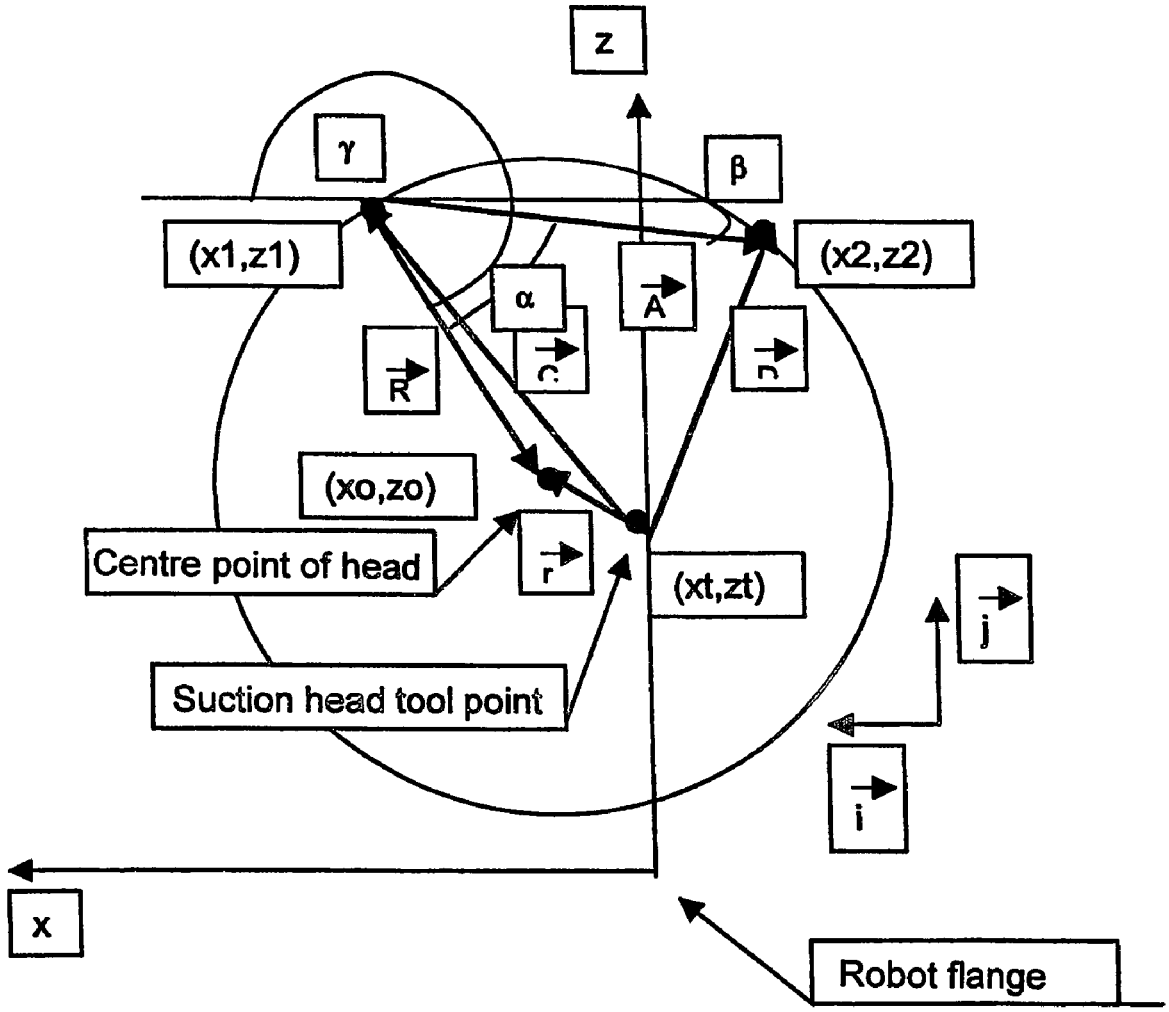
FIG. 2 shows a schematic diagram of the second calculation stage in the measuring method according to the invention.

After determining the points (x1,z1) and (x2,z2), the position of the centre point of the head within the set of co-ordinates of the suction head is calculated. This takes place according to FIG. 2.

Vector A is obtained from the difference of the measured points. A=D−C. According to the figure, Vector R is obtained with the aid of angle (and (=180°+α−β. These angles can be determined with the aid of the previously determined points and known vectors and the radius of the head. Finally, the position (x0, z0) of the centre point of the head relative to the tool point of the suction head, which is r=C+R is determined.

With the aid of this information, the head can now be guided precisely to the correct place at the end of the roll being packed.

Figure 3:
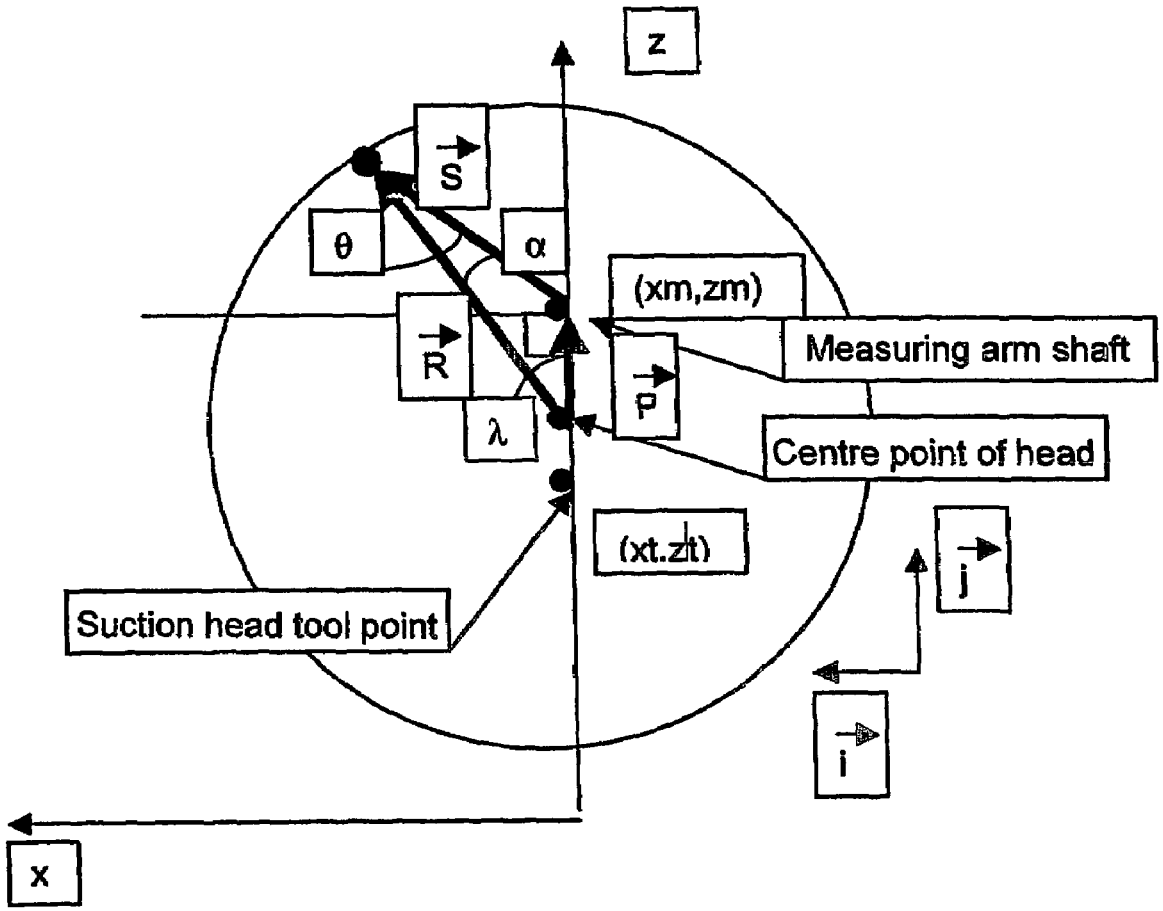
FIG. 3 shows a schematic diagram of the third calculation stage in the measuring method according to the invention.
Figure 4:
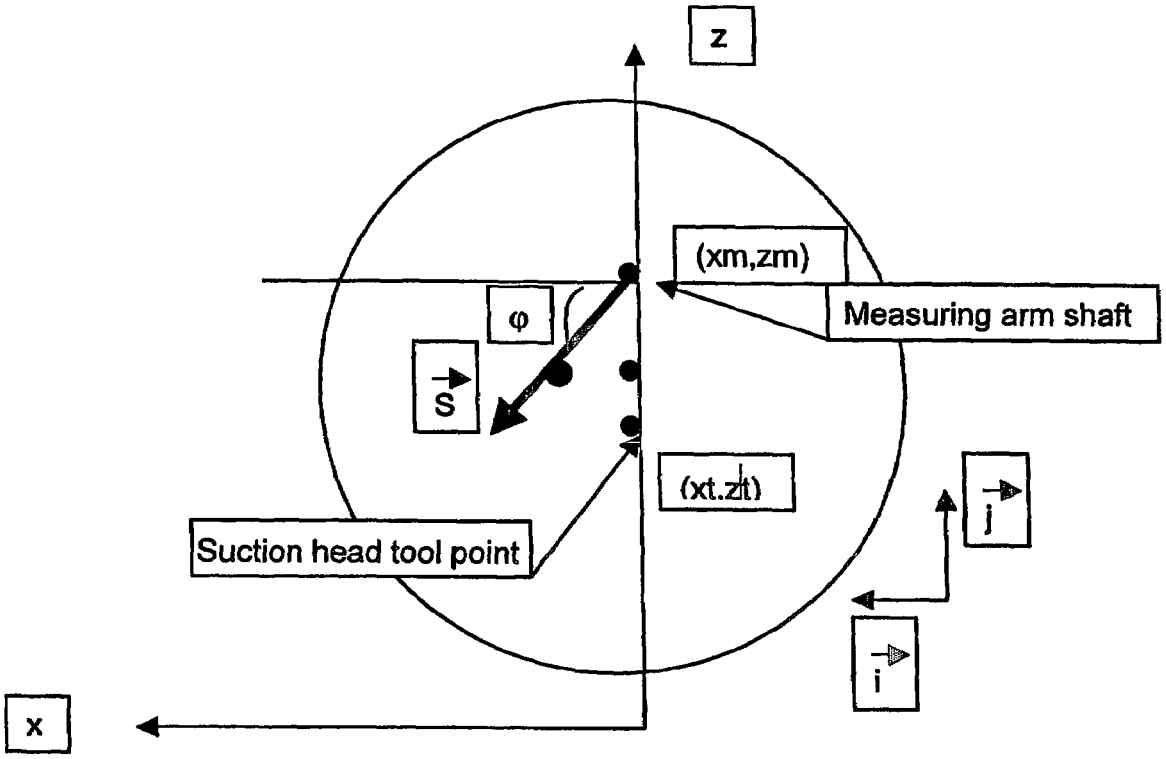
FIG. 4 shows a schematic diagram of the fourth calculation stage in the measuring method according to the invention.

The length of the head measuring arm is calibrated using a calibrating head attached to the suction head, or by shaping the suction head in such a way that a separate plate is not needed. Calibration is required to provide a precise reading after a break in operation, or after initial installation. Thus, calibration may be required, for example, after the grab has struck something, at regular intervals to check its operation, or naturally prior to production start-up when the apparatus is being installed. Calibration with the aid of a calibration head takes place in such a way that the calibration head, the radius R of which is known precisely, is set on the grab and the head is fitted precisely in the desired position with the aid of guides. Its centre point is located on the z axis in theoretically the correct position, FIG. 3.

The length of the measuring arm is calibrated with the aid of a calibration head fitted to the suction head. The measuring arm is rotated slowly clockwise until the photoelectric cell reacts. The angle of the measuring arm is obtained from the absolute sensor, according to FIG. 3. Another alternative is a calibrating seal in the suction head itself, at the location of which a corresponding reaction is obtained from the photoelectric cell.

The calibration head is set precisely in place, so that the vector P between the centre point of the head and the shaft of the measuring arm is known and the vector R between the centre point of the head and the detected point is obtained on the basis of the measured angle of rotation. Because the length of the vector R is the radius of the head, the specific value of the vector S, i.e. the length of the measuring arm, can be calculated with the aid of the angles α, θ, and λ drawn on FIG. 3 and the vectors P and R.

If there is a face for calibration at one extreme side of the measuring element in the suction head of the grab, the length of the measuring arm is calibrated as follows. The angle between the face and the measuring movement corresponds to the angle between a head of, for example, 1000 mm and the tangent of the measuring movement. The face is installed or made in such a way that it is parallel to the Z axis and at a predefined distance from it. Now when the photoelectric cell operates, the value of the angle is measured. With the aid of the distance of the Z axis to the angle face, it is possible to determine the precise length of the measuring arm.

Because the detected angle value of the measuring arm is exploited in the calibration of the length of the measuring arm referred to above, the angle value must be calibrated first. The angle of the measuring arm is calibrated by rotating the measuring arm anticlockwise until the photoelectric cell reacts to the calibration face of the angle of the measuring arm. The face is installed in such a way that its edge form a specific angle j with the shaft of the measuring arm. Once the measuring arm has been rotated to this angle, the correction value is obtained for the reading of the absolute sensor, if the reading of the sensor deviates from the set calibration value. For operation, the sensor of the measuring arm is set by programming to the angle j.

There is a slight time delay in the detection of the edge of the head, which is due to the specific delay of the measuring apparatus and to the shape of the radius of the detector. This time delay is eliminated by constants set in the calculation algorithm. The angle α obtained when measuring the length of the measuring arm is the 'real' angle of the position vector S of the point (x1,z1). When calibrating the time delay, the measuring movement is run normally and the detected angles are read. The results obtained are compared with the theoretical 'real' angle. The difference obtained is the offset of the angle. The measurement is made for both the rising and falling edge of the head.

FIG. 5 shows one device for applying the principle of the invention described above. The device is fitted to the body 1 of the grab, to which a suction plate 2 is also attached. The construction and operation of the suction plate 2 do not, as such, relate to the present invention, so that they are not described in greater detail. A casing 3 is also attached to the body of the grab and the shaft 5 of the measuring arm 6 is fitted to the casing 3 and the body 2. There is a geared motor 4 at the body 2 end of the shaft 5 of the measuring arm 2, with the aid of which the shaft 5 is rotated. At the opposite end of the shaft 5 there is an absolute sensor 8. The type and construction of the sensor do not, as such, affect the implementation of the invention, as long as it can reliably detect the angle of rotation of the shaft. Alternatively, the sensor can be located in connection with the motor 4, or the angle can be read directly from the control of the shaft motor, or the sensor can be located at the side of the shaft, so that the shaft must have markings, to which the sensor can react. The measuring arm 6 is attached to the shaft and at the end of the shaft 6 there is a sensor 7. The sensor 7 can be, for example, a photoelectric cell based on fibre optics.

The casing 3 is attached to the body 1 and the suction plate with the aid of a V-shaped connector plate 9. In this connector plate 9, there is a face 10 for calibrating the angle of the angle of the measuring arm. Calibration takes place by rotating the arm 6 in the direction of the face 10, until the sensor 7 detects the face. The face is formed by cutting the outer edge of the connector plate. In this way, the front edge of the face 10 is parallel to the straight line running through the centre point of the rotation shaft 5 and the angle of rotation can be stated precisely, irrespective of which point of the radius of the detector 7 is intersected by the face. Thus, the length of the measuring arm 6 does not affect the measurement of the angle.

Correspondingly, a face intended for calibrating the length of the measuring arm 6 can be fitted to the device. This face must be arranged in the manner described in the section dealing with the calibration of the measuring arm 6.

Embodiments of the invention, differing from those disclosed above, can also be envisaged. In particular, the mechanical construction of the device referred to above can deviate even considerably from the above description. It is obvious, that the device must be constructed to suit the structure of the grab being used. For example, the operating device rotating the measuring arm 6, the sensors of the device, and the moving and static mechanical components can be shaped as desired, provided that a sensor moving in a circular path and elements for measuring the angle position of the detector can be arranged in the device. The length of the measuring arm and the location of its rotation shaft can selected as desired. However, the location of the rotation shaft should preferably be at a distance from the head tool point, to ensure that the circle of rotation of the end of the measuring arm will always intersect the circle of the edge of the head. It can also be envisaged, that several sensors for detecting several points of intersection can be fitted to the measuring arm, but this is generally unnecessary and will increase the price of the device, as well as demanding increased calculation capacity.

What is claimed is:

1. A method for determining a position of an end head used in rolls of packing paper, cellulose, or board relative to a grab transporting the end head, when the end head is attached to the grab, comprising:

transporting a detector along a circular curve assumed to be intersected by a circular curve defined by an edge of an end head;

measuring an angle position of the detector on the circular curve of its transport path;

detecting intersection points between the circular curve traveled by the detector and the edge of the end head;

calculating a position of a center point of the end head on the basis of:

a) a radius of the circular curve traveled by the detector and the position of the center point of the circular curve traveled by the detector, b) a position of a tool point of the grab, c) an assumed radius of the end head, and d) positions of the detected intersection points; and calculating a position of the center point of the end head in the set of coordinates of the grab.

2. The method of claim 1, wherein the detector is transported at the first end of a measuring arm fitted to a rotation shaft of the grab, and the angle of rotation of the measuring arm on the shaft is measured.

3. The method of claim 2, wherein the measurement of the angle of rotation of the measuring arm is calibrated by rotating the measuring arm towards a face at a predefined rotation-angle position until the face is detected and measurement of the angle of the measuring arm is set on the basis of this angle at which the face is detected.

4. The method of claim 2, wherein a length of the measuring arm is calibrated with the aid of a calibrating end head, the radius of which is known and which is set in a predefined position on the grab.

5. The method of claim 2, wherein the length of the measuring arm is calibrated with the aid of a calibration face formed in the grab, at the position of which a measurement result corresponding to the calibrating end head is obtained.

6. An apparatus for determining a position of an end head used in rolls of packing paper, cellulose, or board relative to a grab transporting the end head, when the end head is attached to the grab, comprising:

a grab comprising a body, elements for gripping an end head, and a predefined tool point;

a measuring arm rotatable on a rotation shaft fitted to the body;

a measuring device, operable for determining an angle of rotation of the measuring arm around the rotation shaft; and a detector attached to the measuring arm, operable for detecting passage of an edge of the end head over the detector.

7. The apparatus of claim 6, wherein the rotation shaft of the measuring arm is disposed a distance from the tool point.

8. The apparatus of claim 7, wherein the grab has a first calibration face parallel to the shaft of the measuring arm and to a predefined angle position on the circumferential path of the measuring arm.

9. The apparatus of claim 8, wherein the grab has a second calibration face, arranged on the circumferential path of the measuring arm in such a way that detection corresponding to the edge of the end head is obtained at its position.

10. The apparatus of claim 7, wherein the grab has a first calibration face arranged on the circumferential path of the measuring arm in such a way that detection corresponding to the edge of the end head is obtained at its position.

11. The apparatus of claim 6, wherein the grab has a first calibration face parallel to the shaft of the measuring arm and to a predefined angle position on the circumferential path of the measuring arm.

12. The apparatus of claim 11, wherein the grab has a second calibration face arranged on the circumferential path of the measuring arm in such a way that detection corresponding to the edge of the end head is obtained at its position.

13. The apparatus of claim 6, wherein the grab has a first calibration face arranged on the circumferential path of the measuring arm in such a way that detection corresponding to the edge of the end head is obtained at its position.

* * * * *